United States Patent [19]

Lesiourd et al.

[11] 3,957,028

[45] May 18, 1976

[54] WIRE-TYPE CUTTING MACHINE

[75] Inventors: Jean-Yves Lesiourd, Limeil-Brevannes; Jacques Charles Louis Bunel, Vigneux-sur-Seine, both of France

[73] Assignee: U.S. Philips Corporation, New York, N.Y.

[22] Filed: June 25, 1974

[21] Appl. No.: 482,906

[30] Foreign Application Priority Data

June 25, 1973 France ..... 73.23049

[52] U.S. Cl. ..... 125/12; 125/16 R; 125/21

[51] Int. Cl.[2] ..... B28D 1/02

[58] Field of Search ..... 125/21, 16 R, 16 L, 125/12

[56] References Cited

UNITED STATES PATENTS

| | | | |
|---|---|---|---|
| 422,988 | 3/1890 | Spring | 125/16 L |
| 2,831,476 | 4/1958 | Wilson | 125/12 |
| 3,478,732 | 11/1969 | Clark | 125/12 |
| 3,635,207 | 1/1972 | Grage | 125/21 |
| 3,831,576 | 8/1974 | Mech | 125/12 |

FOREIGN PATENTS OR APPLICATIONS

| | | | |
|---|---|---|---|
| 128,449 | 2/1902 | Germany | 125/16 R |
| 1,023,430 | 12/1952 | France | 125/16 R |

*Primary Examiner*—Harold D. Whitehead
*Attorney, Agent, or Firm*—Frank R. Trifari; David R. Treacy

[57] ABSTRACT

A wire-type cutting machine comprising a continuously moving wire which is guided over rollers supported by a set of rigid arms in the form of a parallelogram. The wire is pressed against the workpiece by deformation of the parallelogram. Accurate control of the cutting force is achieved, and the wire is automatically released should it become stuck in the workpiece.

6 Claims, 6 Drawing Figures

WIRE-TYPE CUTTING MACHINE

The invention relates to a wire-type cutting machine provided with a support for the workpiece to be cut, means for transporting the wire, and means for displacing the wire in the transverse direction.

Devices of this kind are, for example, known from French Patent Specification No. 1,091,186. This specification describes a device which is used for cutting blocks of stone and which comprises an endless cutting blade which is advanced in the longitudinal direction, the cutting blade being pressured against a block of stone by displacement of the active cutting blade portion in a direction transverse to the said longitudinal direction (that is, in the plane of the cut and transverse to the cutting edge) under the influence of counterweights.

A device of this kind, no doubt very good for cutting large blocks of stone, however, is not suitable for cutting small workpieces; the sensitivity of such a device is insufficient because the press-on force and the transverse displacement of the cutting blade cannot be accurately controlled.

In other known cutting machines, used mainly in the chemical and electronics sector, the workpiece is pressed against the wire by displacement of the support. Because the press-on force must be controlled within very narrow tolerance limits, accurate control of the support is required.

The object of the invention is to provide a wire-type cutting machine in which these drawbacks are eliminated.

According to the invention the means for transverse displacement of the wire are formed by a set of rigid arms in the form of a deformable parallelogram, the arms accommodating rollers for guiding the wire, and by members for deforming the parallelogram. The active portion of the wire can thus be subjected to an accurately controllable force, it being possible to maintain this press-on force constant during the cutting process or to vary it progressively. For a given movement direction of the wire the arrangement of the parallelogram can be chosen such that the wire, should it become stuck in the workpiece, is automatically released again, solely by the tensile force.

The device according to the invention is very sensitive because of the fact that the transverse displacement of the wire is obtained exclusively by rotary movements. The transverse displacement of the wire and the driving of the wire are properly separated; the transverse displacement of the wire is obtained by the members for deforming the parallelogram, whilst driving is effected by means for unwinding and rewinding the wire. Moreover, the device requires little space and has a simple construction.

In a preferred embodiment of the wire-type cutting machine according to the invention, the parallelogram comprises two parallel, pivotably journalled arms which are coupled to each other, and a balancing system which cooperates with at least one of the pivotable arms.

In a further embodiment of the wire-type cutting machine according to the invention, the parallelogram comprises four rigid arms, the ends of the two pivotable arms being interconnected by two horizontal arms.

In another embodiment yet of the wire-type cutting machine according to the invention, the parallelogram comprises three rigid arms, the two pivotable arms of which are interconnected at one end by means of a third, horizontal arm.

The invention will be described in detail hereinafter with reference to the accompanying drawing.

Figure 1:
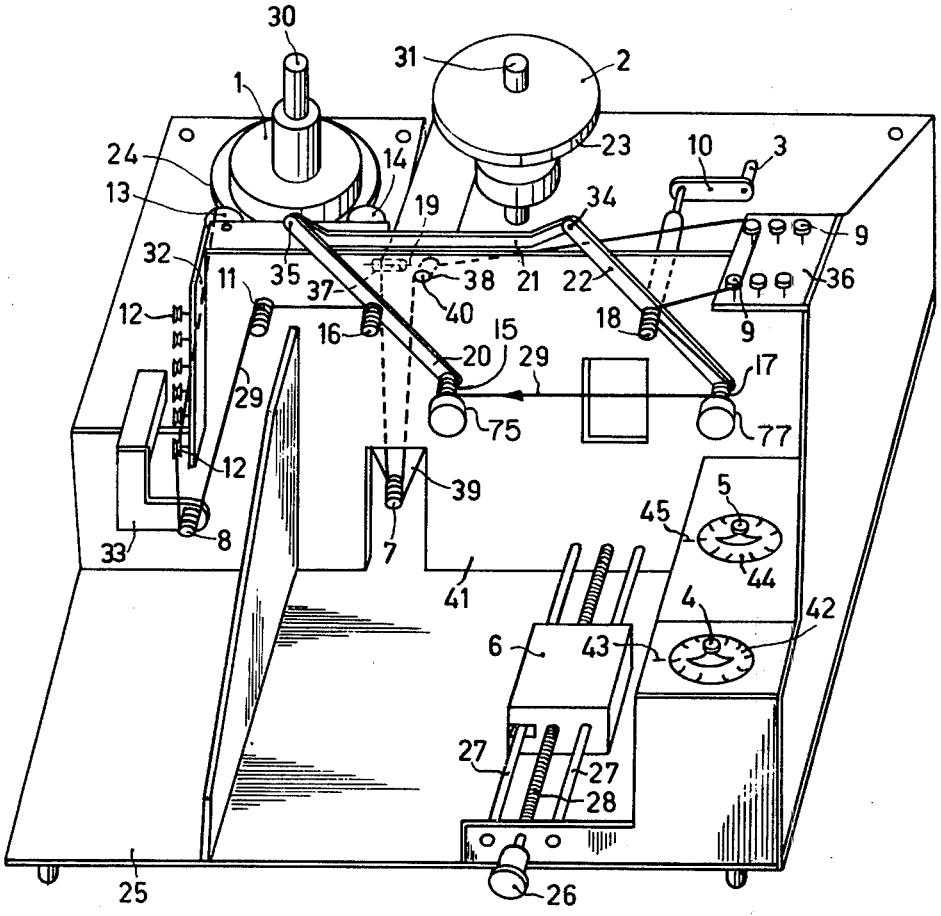
FIG. 1 is a perspective view of a preferred embodiment of the wire-type cutting machine according to the invention.

The wire-type cutting machine shown in FIG. 1 comprises two winding units 1 and 2 of a known type provided with a disc with coupling and brake and connected to a shaft 30, 31. One of these units serves for the wire transport, whilst the other exerts a braking effect on the wire so as to keep it taut. The shafts 30, 31 are driven by a motor (not shown in the Figure) which is mounted on the wire-cutting machine; the disc of the unit 1 is provided with a groove 24, while the disc of the unit 2 comprises a groove 23. A bracket 32, mounted on the cabinet 25 of the wire-type cutting machine, supports guide wheels 12. A second bracket 33, also mounted on the cabinet 25, supports a loose roller 8, whilst another loose roller 11 is mounted directly on cabinet 25. A parallelogram which is formed by three rigid arms 20, 21, 22, the two slanted arms 20 and 22 being parallel and of the same length while the arm 21 is horizontal, supports a few loose rollers: on the one side the roller 15 on the lower end of arm 20 and the roller 16 in the center of the arm 20, and on the other side the roller 17 on the lower end of the arm 22 and the roller 18 in the centre of said arm 22. The arms 20 and 21 are connected by a pivot pin 35, while the arms 21 and 22 are interconnected by a pivot pin 34. The parallelogram thus formed is secured on a plate 41 which forms part of the cabinet 25 by the shafts of the rollers 16 and 18, the shaft of roller 18 being rigidly connected to the arm 22. Secured on the shaft of the roller 18 is a rod 10, the end of which supports a counterweight 3. On the other side, a few guide wheels 9 are provided on a plate 36 which is connected to the cabinet 25 and which bears on the plate 41. A loose roller 38 is mounted on the rear of the plate 41 by way of the shaft 40 of this roller, while another loose roller 7 is mounted on a plate 39 connected to the cabinet 25. A roller 37 is connected on the rear of the vertical plate 41 by way of a shaft 19. Reversing rollers 13 and 14 are connected on the cabinet 25 and are rotatable about a vertical shaft. The rollers 7, 8, 11, 13 to 18, 37 and 38 are provided with a plurality of grooves for guiding the wire.

The means for controlling the speed of the wire 29 are diagrammatically denoted by a knob 4 with a scale 42 which is rotatable with respect to a fixed marking line 43; the means for controlling the tension in the wire are diagrammatically represented by a knob 5 with a scale 44 which moves in front of a mark 45. A slide 6, serving as a support 6 for the workpiece to be cut, is guided by two bars 27 and can be displaced by means of a worm 28 operated by means of a knob 26. Furthermore, containers of a suitable shape (not shown in FIG. 1) can be placed in the opening of the plate 41 opposite the roller 7 and the opposite the roller 8 so as to supply the wire 29 with cutting medium.

The operation of this wire-type cutting machine is as follows: from the groove 24 of the disc of the unit 1 the wire 29 extends on the rear of the plate 41 successively over the rollers 19, 7, 38 and is subsequently passed to the front of the plate 41 over guide wheels 9; the wire subsequently passes over the rollers 18, 17, 15, 16, 11, 8 and over one of the wheels 12 to the reversing roller 13.

Two modes of operation are feasible:

— if cutting is effected by means of a single wire segment, the wire is directly wound, by way of the reversing roller 14, in the groove of the disc of the unit 2;

— if cutting is effected by means of a plurality of parallel wire segments, that is, in the case of a multiple cutting operation, the wire again arrives in one of the grooves of the roller 19 at the exit of the reversing roller 14; the described cycle then commences again, the wire each time passing through one of the free grooves of the loose rollers and over different guide wheels 12 and 9. The number of guide wheels and rollers and the location thereof is determined by the situation of the means for unwinding and rewinding the wire.

The workpiece to be cut is placed on the slide 6 and is put in the desired position by means of the members shown in FIG. 1; the workpiece further remains stationary. The parallelogram is deformed such that the wire exerts a given force on the workpiece. The units 1 and 2 are driven, while the wire 29 exerts a given force on the workpiece with the aid of the counterweight 3. The value on this force is dependent of the cutting medium used (a grinding agent or electrolyte). In the embodiment shown in FIG. 1, the parallelogram comprises only three rigid arms. This does not cause unbalance, however, provided that the weight of the lacking (fourth) arm is substituted by two small counterweights 75 and 77 which are connected to the rollers 15 and 17 or that the parallelogram is balanced some other way. The system using three arms offers more freedom as regards the workpiece dimensions because there is no interference from a fourth, horizontal lower arm which might come into contact with the workpiece to be cut.

Figure 2:
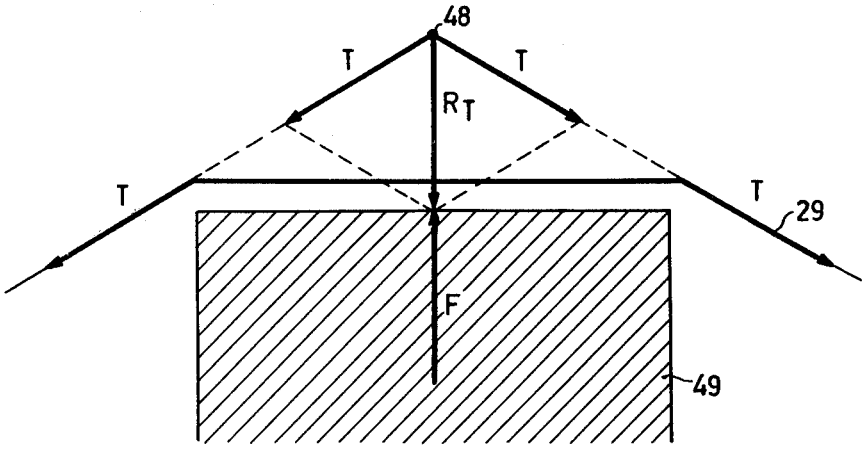
FIG. 2 is a diagram of the forces exerted on the wire and the workpiece.

FIG. 2 shows the forces occurring during cutting, the deformation of the wire 29 being shown in an exaggerated way for the sake of clarity. Each end of the active portion of the wire 29 exerts a force T on the workpiece 49, the resultant of these forces T equalling $R_T$ at the point 48. In the balanced condition, the reactive force F exerted on the wire by the workpiece equals the said resultant $R_T$.

Figure 3:
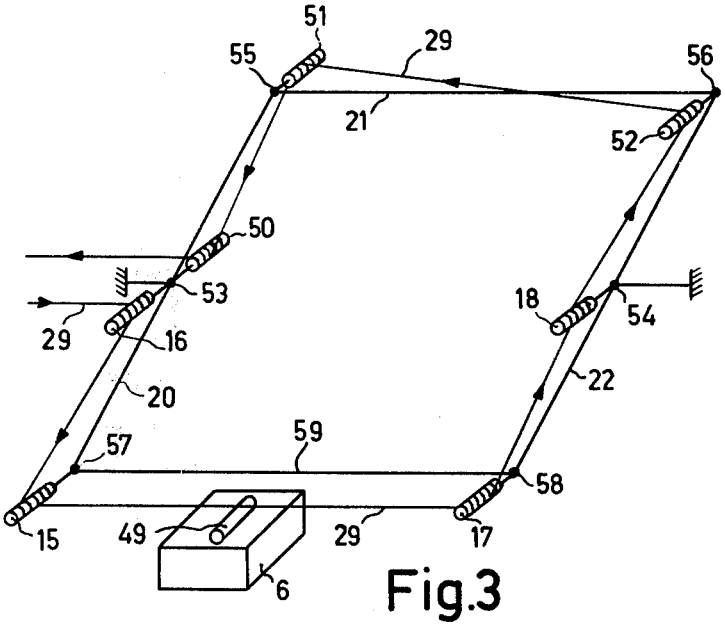
FIG. 3 is a perspective view of another embodiment of the wire-type cutting machine according to the invention.

FIG. 3 shows a second feasible embodiment of the parallelogram for obtaining the transverse displacement of the wire. Members corresponding to FIG. 1 are denoted by the same references. The parallelogram comprises four rigid arms 20, 21, 22 and 59 (FIG. 1 depicts the arms 20, 21 and 22).

Because of the fact that the cutting wire 29 enters the parallelogram and departs therefrom on both sides of the point 53, it is necessary to add a given number of loose wheels to the system in comparison with FIG. 1, so as to maintain the symmetry of the system. At the front of the parallelogram, the loose grooved rollers 15, 16, 17, 18 and 52 are connected to the points 57, 53, 58, 54 and 56, respectively. Connected on the other side of the plane of the parallelogram are the loose rollers 50 and 51 at the points 53 and 55, respectively. The workpiece 49 to be cut is clamped on the support 6 by way of the means shown in FIG. 1. The parallelogram is connected to the cabinet of the cutting machine at the points 53 and 54 by way of the shafts of the relevant rollers 16 and 18. The members which serve for the deformation of the parallelogram and which, like in the previous embodiment, can be formed by a simple counterweight or any other device, are not shown in the Figure.

The operation of the cutting machine by means of a parallelogram as shown in FIG. 3 is similar to that described with reference to FIG. 1. The wire successively passes over the rollers 16 and 15, along the workpiece 49, then over the rollers 17, 18 and 52, through the plane of the parallelogram and next over the rollers 51 and 52 before it reaches the members for driving the wire. As in the described embodiment, a system of reversing rollers permits simultaneous cutting of a plurality of slices of given thickness by means of a given number of wire segments. It is to be noted that during the cutting operation the arm 59 always remains parallel to the straight line through the points 53 and 54, only the point of application of the force $R_T$ (determined in FIG. 2) being displaced during cutting. On the other hand, whatever the deformation of the parallelogram, the wire tension does not change; this is a result of the symmetry of the assembly formed by the rollers. When the system according to FIG. 3 is used, a slight torsional torque occurs at point 53 due to the fact that the tensile force of the wire on one side of the parallelogram opposes the tensile force of the wire on the other side of the parallelogram.

In order to enhance the sensitivity of the system, small ball-bearings are methodically used for journalling the loose rollers and in the pivots 55, 56, 57 and 58 of the parallelogram.

The movement direction of the wire 29 should be such that should the wire become stuck in the workpiece, it is automatically released therefrom by its tensile force. For example, if the wire becomes stuck in the groove cut into the workpiece 49 in FIG. 3, the tensile force T of the wire exerts a force which, with respect to the rigid shaft 54, produces a torque opposing that exerted on the parallelogram by the counterweight. Conversely, the same effect is obtained in the case of a reversed movement direction of the wire and an arrangement of the parallelogram which is symmetrical with respect to that of FIG. 3.

Figure 4:
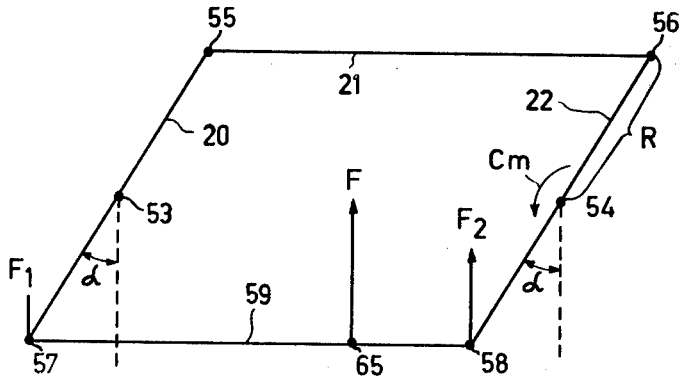
FIG. 4 is a diagram of the forces and torques exerted on the parallelogram.

In FIG. 4 the parallelogram and the cutting wire are represented by the same lines for the sake of simplicity. This Figure shows the various forces and torques exerted on the parallelogram. At the point 54 the torque Cm engages which tends to deform the parallelogram, and which produces the forces F1 and F2 at the points 57 and 58, respectively, the resultant F thereof engaging at the point 65 where the wire is in contact with the workpiece to be cut; during the cutting the point 65 moves along the line interconnecting the points 57 and 58. R denotes half the length of the pivotable arms 20 and 22, for example, the distance between the points 54 and 56 or the points 54 and 58; $\alpha$ is the angle enclosed by the pivotable arms 20 and 22 and the vertical;

the resistance torque produced by the workpiece to be cut is given by the relation:

$$(F1 + F2)\ R \sin \alpha = F.R. \sin \alpha.$$

In the balanced condition this torque is equal to the torque Cm which tends to deform the parallelogram.

Figure 5:
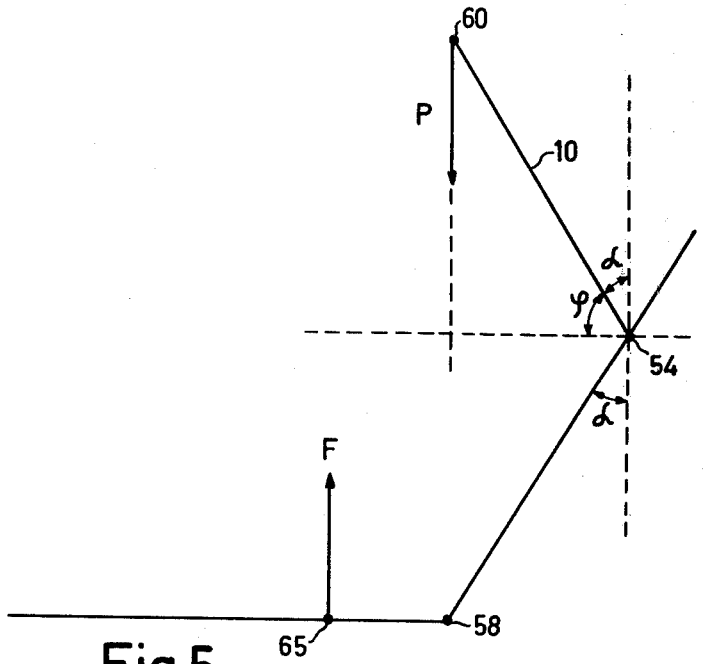
FIG. 5 is a force diagram of the operation of the balancing system.

FIG. 5 shows the situation for obtaining a constant press-on force F. This Figure shows only a small portion of the parallelogram. At the point 54 the lever 10 shown in FIG. 1 is connected to the end supporting the counterweight 3 which delivers a force P.

If a constant force F is desired at the point 65 during sawing, the angle $\phi$ between the arm 10 and the horizontal should equal the said angle $\phi$.

This is because the torque Cm acting at point 54 is equal to:

$$Cm = P.r. \cos \phi,$$

in which $r$ is the length of the lever 10.

In the balanced condition, i.e. when the torque Cm equals the resistance torque, the following equality thus holds good:

$$P.r. \cos \phi = F.R. \sin \alpha.$$

Because $P$, $r$, $R$ are constant during the cutting operation, the force F is kept constant if:

$$\cos. \phi = \sin \alpha$$

or $$\phi = (\pi/2 - \alpha),$$

which is shown in FIG. 5.

It will be obvious that if the pivotable arms of the parallelogram were to occupy the opposite slanted position with respect to the vertical, the lever 10 would occupy a corresponding position.

The construction conidtion $\phi = \pi/2 - \alpha$ can be readily realized and enables a cutting force to be obtained which is constant, thus satisfying the requirements for most cutting operations (workpieces having a rectangular or square cross-section).

In the case of a workpiece having, for example, a triangular cross-section, it is sufficient to exert a force P which is proportional to the contact area between wire and workpiece and which is bound to a given physical parameter, for example, the extension if a spring is concerned.

If the contact length between wire and workpiece to be cut varies strongly, the cutting force F should also be variable.

For example, a force F can be obtained which gradually varies thanks to the use of a roller having its shaft connected at the point 54, the roller being subjected to a constant tensile force. For the torque Cm any change according to a desired function can be generally obtained by the use of all sorts of known members (mechanical, electronic, pneumatic, hydraulic members etc.).

Figure 6:
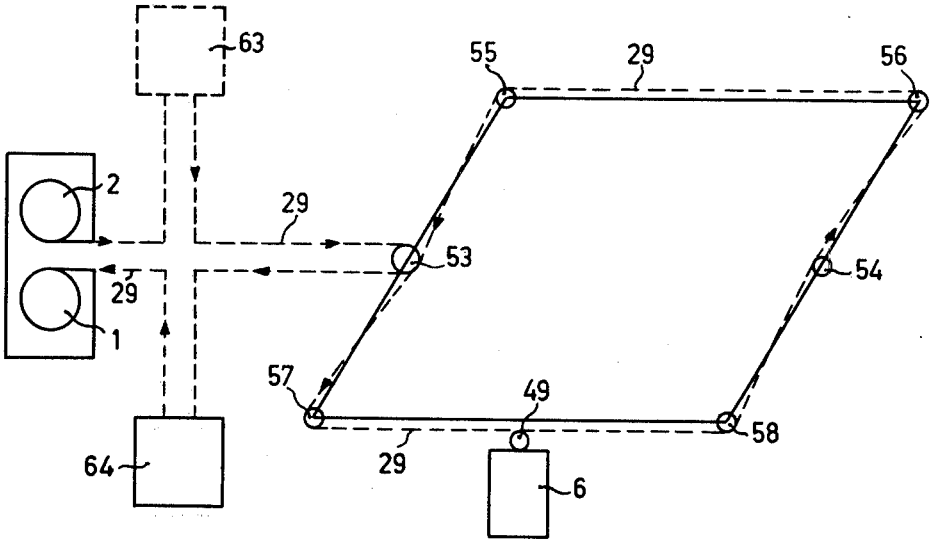
FIG. 6 shows a diagram of the path of the wire in the case of a parallelogram comprising four arms.

FIG. 6 diagrammatically illustrates a cutting operation which is chemically effected. To this end, containers 63 and 64 are inserted in the path to be followed by the wire; in container 63 the moving wire picks up a given quantity of chemical cutting medium, whilst the wire is "rinsed" in the container 64. The further operation of this cutting machine is as already described.

Besides the described embodiments of the invention, there are other solutions within the scope of the invention for driving the wire over a single path or a plurality of paths and for deformation of the parallelogram.

We claim:

1. A wire-type cutting machine comprising a support for holding a workpiece to be cut in a given location, means for transporting a wire along a given direction and a means for displacing the wire in a transverse direction across said location, wherein the means for transverse displacement comprises a single parallelogram linkage comprising first and second parallel elements each mounted for pivotal motion about parallel axes, said elements having respective first and second wire guide points equally spaced from said axes, means for guiding the wire about said guide points, said wire travelling in said given direction from said first guide point to said second guide point, means for maintaining said elements parallel, and means for pivoting said elements about said axes so as to cause said first guide point to approach said given location, said parallelogram being so disposed that said pivoting will press the wire against a workpiece in said location, whereby the direction of wire transportation and parallogram pivoting are such that friction or sticking of the wire moving against a workpiece tends to cause the parallel members to pivot in a direction opposite to said means for pivoting and therefore to move the wire out of contact with the workpiece.

2. A machine as claimed in claim 1, wherein said means for pivoting comprises a shaft rigidly connected to one of said parallel elements coaxial with said axes, and a counterweight connected to said shaft for torsionally biassing said element about said axes.

3. A machine as claimed in claim 1, wherein said means for pivoting comprises balancing means connected to at least one of said elements for balancing the parallelogram about said axes, said parallel elements each having upper and lower ends respectively remote from said axes, said linkage further comprising a third horizontal arm only, pivotally connected to said upper ends.

4. A machine as claimed in claim 1, wherein said parallel elements each have upper and lower ends respectively removed from said axes, said linkage further comprising two horizontal arms pivotally connected to said upper and lower ends respectively.

5. A machine as claimed in claim 1, wherein said means for guiding a wire comprises roller elements disposed at each of the corners of the parallelogram and coaxial with each of said axes, two of said rollers being disposed at said respective guide points, at least one of said roller elements being disposed to one side of a plane defined by said parallel elements, the others of said roller elements being disposed to the other side of said plane.

6. A machine as claimed in claim 1, further comprising two winding units, each winding unit comprising a disc, a coupling and a brake.

* * * * *